US005328294A

United States Patent [19]

Miller

[11] Patent Number: 5,328,294

[45] Date of Patent: Jul. 12, 1994

[54] MANHOLE CASTING SETTING FIXTURE

[76] Inventor: Rex Miller, 5149 Kipp Way, Carmichael, Calif. 95608

[21] Appl. No.: 786,456

[22] Filed: Nov. 1, 1991

[51] Int. Cl.[5] ..... E02D 29/14; B22C 9/24

[52] U.S. Cl. ..... 404/25; 249/145

[58] Field of Search ..... 404/25, 26, 4; 29/45; 249/11, 83, 145-146, 177, 183-184, 155; 264/145, 256; 52/20-21

[56] References Cited

U.S. PATENT DOCUMENTS

| | | | |
|---|---|---|---|
| 645,254 | 3/1900 | Forker | 249/148 |
| 1,852,928 | 4/1932 | Helling | 404/26 |
| 3,847,339 | 11/1974 | Farrell | 249/179 X |
| 4,177,229 | 12/1979 | Moore | 249/145 X |
| 4,318,880 | 3/1982 | McIntosh et al. | 264/267 |
| 4,536,103 | 8/1985 | Prescott | 404/26 |
| 4,637,585 | 1/1987 | Picollo | 249/83 |
| 4,685,650 | 8/1987 | Ditcher | 249/11 X |
| 4,867,411 | 9/1989 | Dorsey et al. | 249/11 |

*Primary Examiner*—Kenneth J. Dorner
*Assistant Examiner*—Nancy P. Connolly
*Attorney, Agent, or Firm*—Jerry T. Kearns

[57] ABSTRACT

A manhole casting setting fixture includes a pair of spaced parallel frame rails connected by a plurality of transverse struts. Four loop handles are secured at opposite ends of the frame rails to facilitate manual manipulation and transportation of the fixture. A pair of clamp mounting blocks are positioned in juxtaposed relation centrally on bottom surfaces of the frame rails. A pair of lead screws extend through respective threaded coaxial bores in the mounting blocks and include handle portions to facilitate manual loosening and tightening of the lead screws. A pair of arcuate clamping jaws are rotatably mounted on oppositely directed end portions of the lead screws. In use, a manhole casting is positioned level with the bottom surfaces of the parallel frame rails and the clamping screws are manually adjusted to engage the arcuate clamping jaws with diametrically opposed interior side wall portions of the manhole casting, thereby clamping the casting into proper level alignment with respect to the parallel frame rails. The setting fixture and attached manhole casting are then carried to the manhole and properly positioned relative thereto. The setting fixture maintains the manhole casting in proper position until the casting is permanently set in position by the application of cement, asphalt or other roadway paving material.

16 Claims, 3 Drawing Sheets

MANHOLE CASTING SETTING FIXTURE

BACKGROUND OF THE INVENTION

1. Field of the Invention

The present invention relates to manhole casting setting fixtures, and more particularly pertains to an improved manhole casting setting fixture adapted to facilitate precise alignment of a manhole casting prior to and during application of a paving material such as cement or asphalt.

2. Description of the Prior Art

Various types of fixtures are known in the prior art. A typical example of such a fixture is to be found in U.S. Pat. 645,254, which issued to D. Forker on Mar. 13, 1900. This patent discloses a mold for use in the construction of cement water tanks which includes a pair of spaced parallel frame rails connected by a plurality of transverse struts. The mold includes inner and outer portions and has a collapsible construction to facilitate set up and take down as well as transportation. U.S. Pat. No. 1,852,928, which issued to H.A. Helling on Apr. 5, 1932, discloses a method and apparatus for forming new tops on underground valve boxes. This patent contemplates the use of a cast, press, spun or otherwise constructed supplemental top section having a lower end adapted to be telescopically engaged within the upper end of the upper section of an existing valve box. The supplemental top section is supported by and encased in cement, grout, concrete or other equivalent plastic filling substance which, in addition to supporting the supplemental section, serves to repair the hole formed in the road or pavement. In use, the supplemental top section is supported at the proper level of its upper end by securement to a board extending transversely across a hole formed in a road surface. U.S. Pat. No. 4,318,880, which issued to R Mcintosh et al on Mar. 9, 1982, discloses a method and apparatus for forming manhole bases in an excavation by the utilization of an outer form. A preformed manhole barrel is positioned and propped within an outer formed pipe stub inserted partially into the inside of a preformed manhole and rests under notches cut into the performed manhole barrel. Inflatable or rigid forms are used to form channels in the concrete to be poured. Concrete is then poured after setting of the form and the forms are deflated and removed for reuse. The device includes a plurality of screw actuated clamping fixtures for securement of the preformed manhole casting barrel. U.S. Pat. No. 4,536,103, which issued to E. Prescott on Aug. 20, 1985, discloses an adjustable cast iron or ductile iron manhole frame for use in a method of construction utilizing a formed concrete base that supports both the frame and pavement. The height and angle of the frame determines the height and angle of the formed concrete base.

While the above mentioned devices are directed to various setting and alignment fixtures, none of these devices discloses an easily transportable fixture including a clamping mechanism for rapidly and easily securing a manhole casting in proper alignment for subsequent transportation and location at an intended mounting location in hole in a road surface. Additionally, none of these devices engages solely the inner upper surface of a manhole casting and thus allows the unobstructed application of concrete, asphalt, or other paving material around the manhole casting while secured in the fixture. Inasmuch as the art is relatively crowded with respect to these various types of fixtures, it can be appreciated that there is a continuing need for and interest in improvements to such fixtures, and in this respect, the present invention addresses this need and interest.

SUMMARY OF THE INVENTION

In view of the foregoing disadvantages inherent in the known types of casting setting fixtures now present in the prior art, the present invention provides an improved manhole casting setting fixture . As such, the general purpose of the present invention, which will be described subsequently in greater detail, is to provide a new and improved manhole casting setting fixture which has all the advantages of the prior art casting setting fixtures and none of the disadvantages.

To attain this, representative embodiments of the concepts of the present invention are illustrated in the drawings and make use of a manhole casting setting fixture which includes a pair of spaced parallel frame rails connected by a plurality of transverse struts. Four loop handles are secured at opposite ends of the frame rails to facilitate manual manipulation and transportation of the fixture. A pair of clamp mounting blocks are positioned in juxtaposed relation centrally on bottom surfaces of the frame rails. A pair of lead screws extend through respective threaded coaxial bores in the mounting blocks and include handle portions to facilitate manual loosening and tightening of the lead screws. A pair of arcuate clamping jaws are rotatably mounted on oppositely directed end portions of the lead screws. In use, a manhole casting is positioned level with the bottom surfaces of the parallel frame rails and the clamping screws are manually adjusted to engage the arcuate clamping jaws with diametrically opposed interior side wall portions of the manhole casting, thereby clamping the casting into proper level alignment with respect to the parallel frame rails. The setting fixture and attached manhole casting are then carried to the manhole and properly positioned relative thereto. The setting fixture maintains the manhole casting in proper position until the casting is permanently set in position by the application of cement, asphalt or other roadway paving material.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved manhole casting setting fixture which has all the advantages of the prior art casting setting fixtures and none of the disadvantages.

It is another object of the present invention to provide a new and improved manhole casting setting fixture which may be easily and efficiently manufactured and marketed.

It is a further object of the present invention to provide a new and improved manhole casting setting fixture which is of a durable and reliable construction.

An even further object of the present invention is to provide a new and improved manhole casting setting fixture which is susceptible of a low cost of manufacture with regard to both materials and labor, and which accordingly is then susceptible of low prices of sale to the consuming public, thereby making such casting setting fixtures economically available to the buying public.

Still yet another object of the present invention is to provide a new and improved manhole casting setting fixture which provides in the apparatuses and methods of the prior art some of the advantages thereof, while simultaneously overcoming some of the disadvantages normally associated therewith.

Still another object of the present invention is to provide a new and improved manhole casting setting fixture which allows a manhole casting to be secured to the fixture in a properly aligned condition at a location remote from the intended installation site.

Yet another object of the present invention is to provide a new and improved manhole casting setting fixture which includes a pair of oppositely directed screw actuated clamping jaws adapted for engagement with interior side wall surfaces of a manhole casting so as to allow unobstructed application of cement, asphalt or other paving material around the manhole casting while clamped in the fixture.

Even still another object of the present invention is to provide a new and improved manhole casting setting fixture for maintaining a manhole casting in proper level alignment prior to and during the application of cement, asphalt or other paving material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
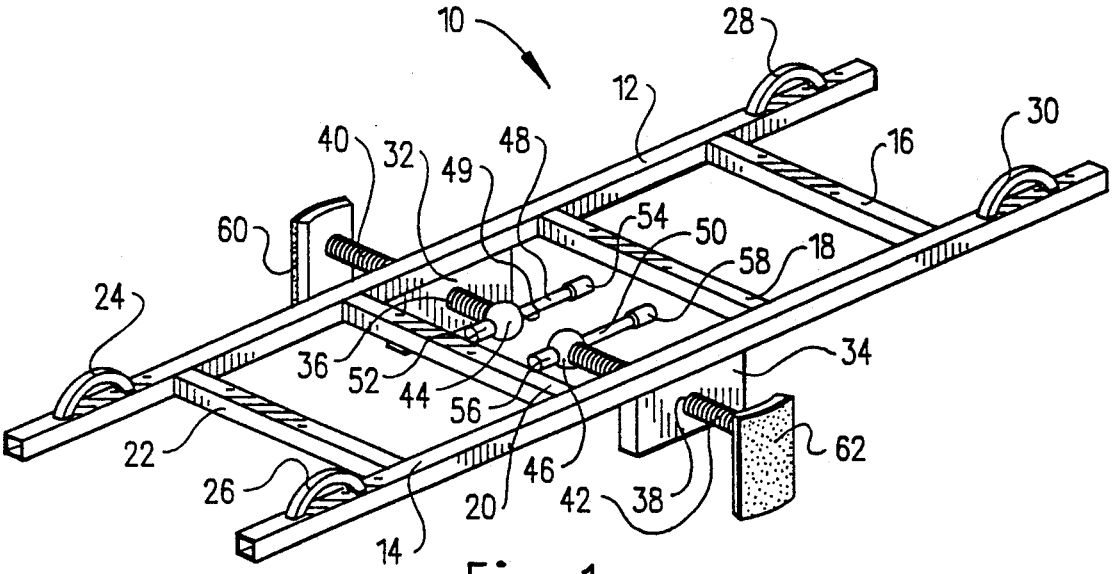
FIG. 1 is a perspective view of the manhole casting setting fixture according to a first embodiment of the present invention.
Figure 2:
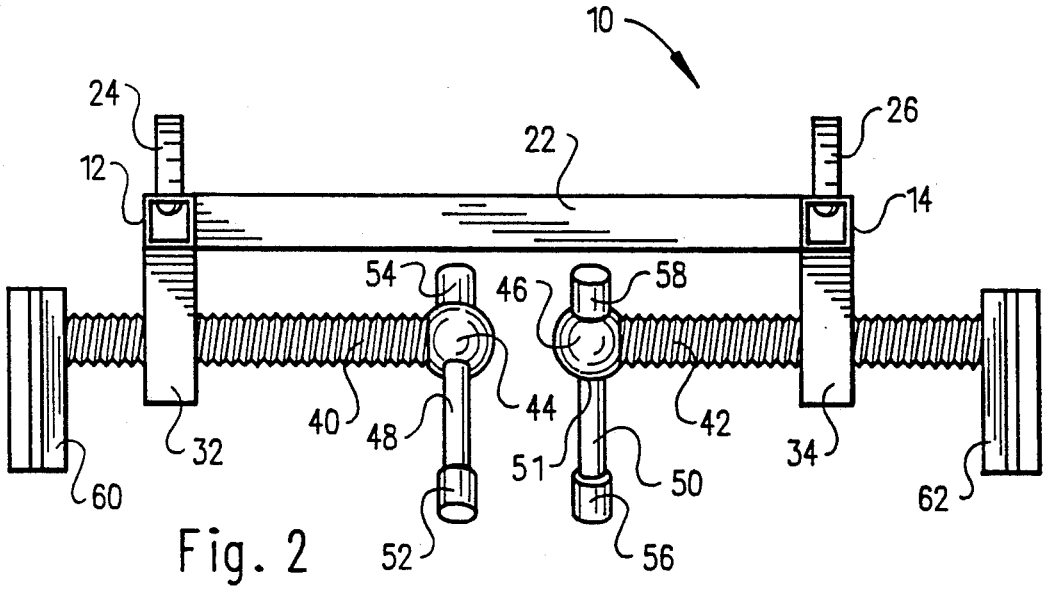
FIG. 2 is an end view of the manhole casting setting fixture according to the first embodiment of the present invention.

With reference now to the drawings, and in particular to FIG. I through 7 thereof, a new and improved manhole casting setting fixture embodying the principles and concepts of the present invention and generally designated by the reference numeral 10 will be described.

Figure 7:
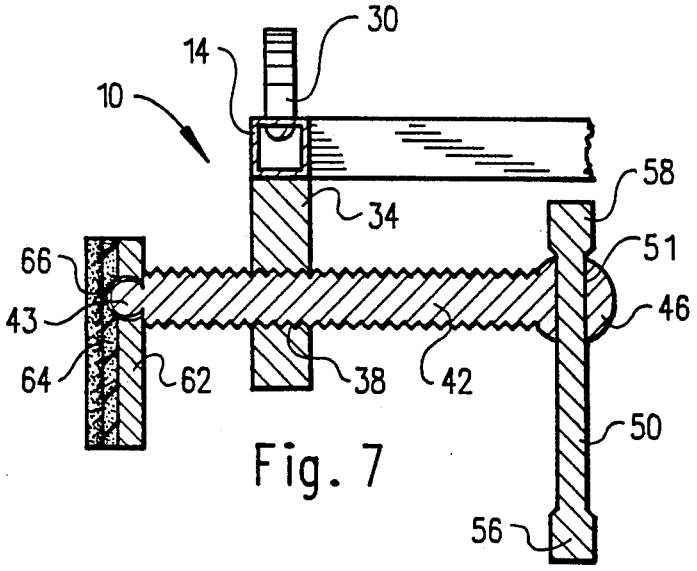
FIG. 7 is a cross sectional detail view, taken along line 7—7 of FIG. 5.

More specifically, it will be noted that the first embodiment 10 of the invention includes spaced parallel frame members in the form of rails 12 and 14 connected by a plurality of spaced transverse struts 16, 18, 20 and 22. The frame rails 12, 14 and the transverse struts 16, 18, 20 and 22 are preferably formed from a rigid metal material such as steel and may be assembled by welding or other conventional fastening methods. A plurality of loop handles 24, 26, 28 and 30 are secured in aligned relationship at opposite ends of the respective frame rails 12 and 14. The pair of clamp mounting blocks 32 and 34 are secured to bottom surfaces of the frame rails 12 and 14 in a juxtaposed centrally aligned position. Threaded apertures 36 and 38 are formed in coaxial relation through the respective mounting blocks 32 and 34 for the reception of lead screws 40 and 42. Spherical knob ends 44 and 46 are formed on inwardly disposed end portions of the lead screws 40 and 42. Central transverse cylindrical bores 49 and 51 formed respectively through the knob end portions 44 and 46 receive rigid cylindrical metal rods 48 and 50, which form T-handles to facilitate manual rotation of the screws 40 and 42. The handle bars 48 and 50 include enlarged diameter end portions 52, 54, 56 and 58 to prevent the handle rods 48 and 50 from becoming separated from the knob end portions 44 and 46. In the manner of a conventional screw-type vice handle, the end portions 52, 54, 56 and 58 may be secured to the handles 48 and 50 subsequent to insertion through the apertures 49 and 51. Thus, each of the handle rods 48 and 50 may be positioned laterally with respect to the associated knob 44, 46, within the constraints of the enlarged end portions 52, 54, 56 and 58. Arcuate clamping jaws 60 and 62 are rotatably secured to interior distal end portions of the lead screws 40 and 42. As shown in the cross sectional view of FIG. 7, each of the arcuate clamping jaws, for example the clamping jaw 62, includes a backing plate 64 and a socket 66 which receives a ball end portion 43 of the associated lead screw 42. Thus, the screw 42 is rotatable relative to the clamping jaw 62 and backing plate 64. The ball 43 and socket 66 connection preferably also allows limited angular adjustment of the clamping jaw 62 in the manner of a ball and socket pivotal connection. The ball and socket connection may be effected in a variety of different ways, within the scope of the invention. For example, the backing plate 64 may be deformed subsequent to insertion of the ball 43 within the socket 66 to capture the ball 43 therein. Alternatively, the ball 43 may be formed as a separate component from the screw 42 and secured subsequent to insertion of a reduced end portion of the screw 42 through an aperture in the backing plate 64. The jaw 62 may be then secured by threaded fasteners, or by welding to the backing plate 64.

The clamping jaw 60 and 62 and associated backing plates 64 may be formed from metal, or from a resilient friction enhancing material such as rubber. The backing plates 64 are preferably formed with a cylindrical concave curvature dimensioned for conformance with the interior cylindrical sidewall of a conventional manhole casting. Such castings take the form of cylindrical cast metal rings having a height of from four to seven inches.

Figure 3:
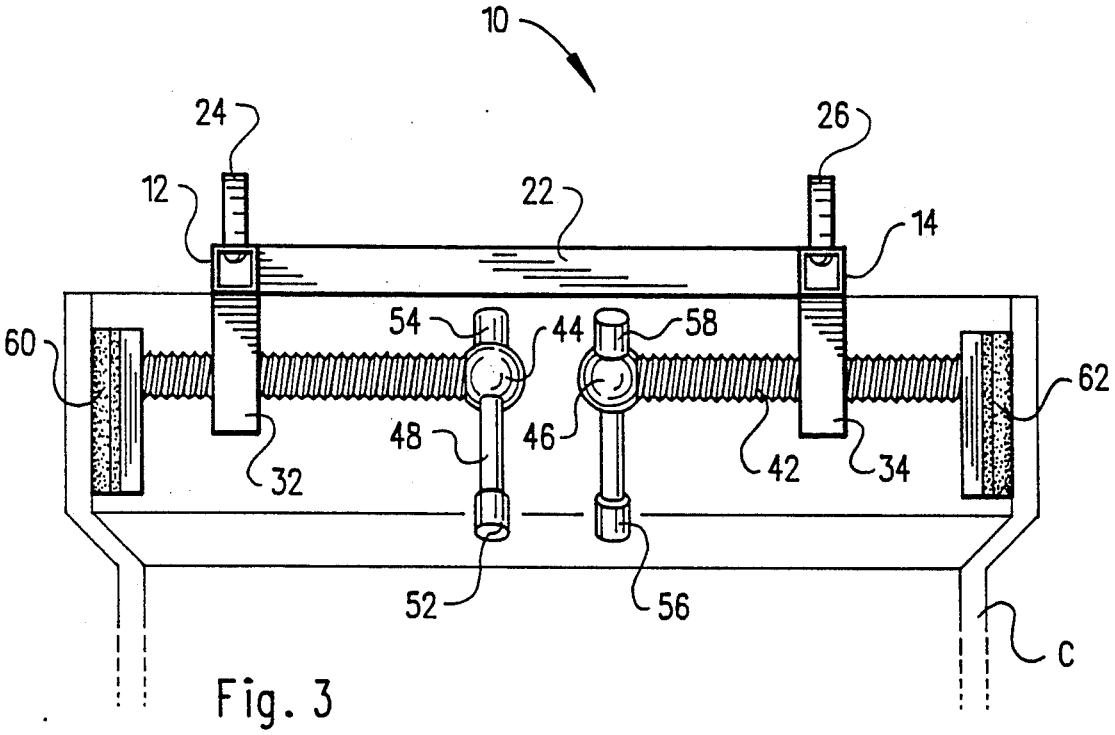
FIG. 3 is an end view of the manhole casting setting fixture according to the first embodiment of the present invention shown in operative engagement with a manhole casting.
Figure 4:
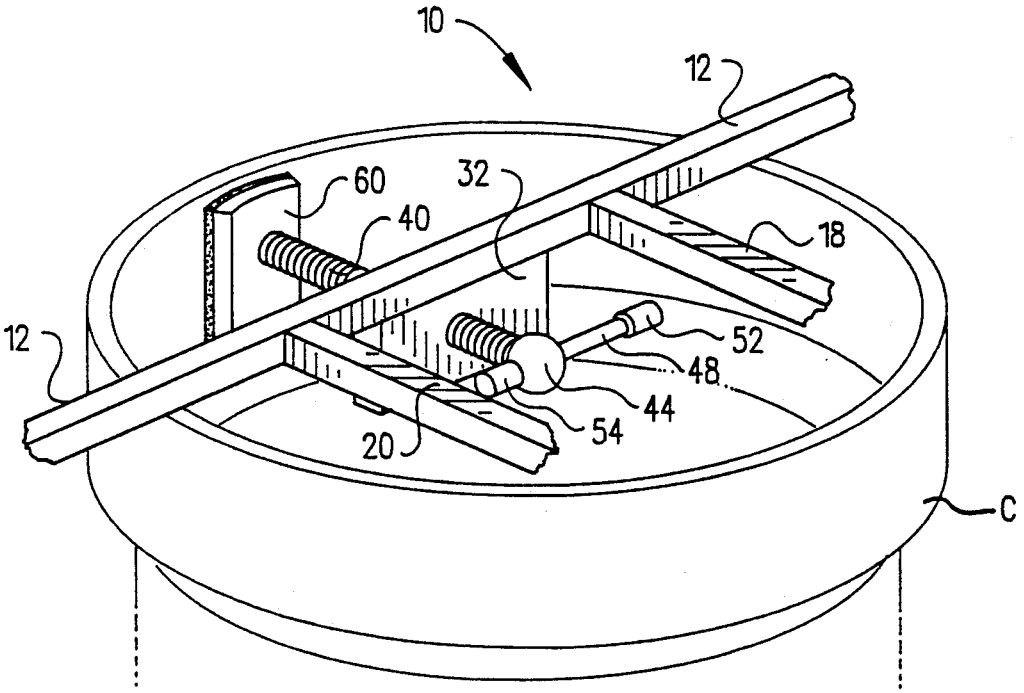
FIG. 4 is a partial perspective detail view further illustrating the engagement of the manhole casting setting fixture with a manhole casting.
Figure 5:
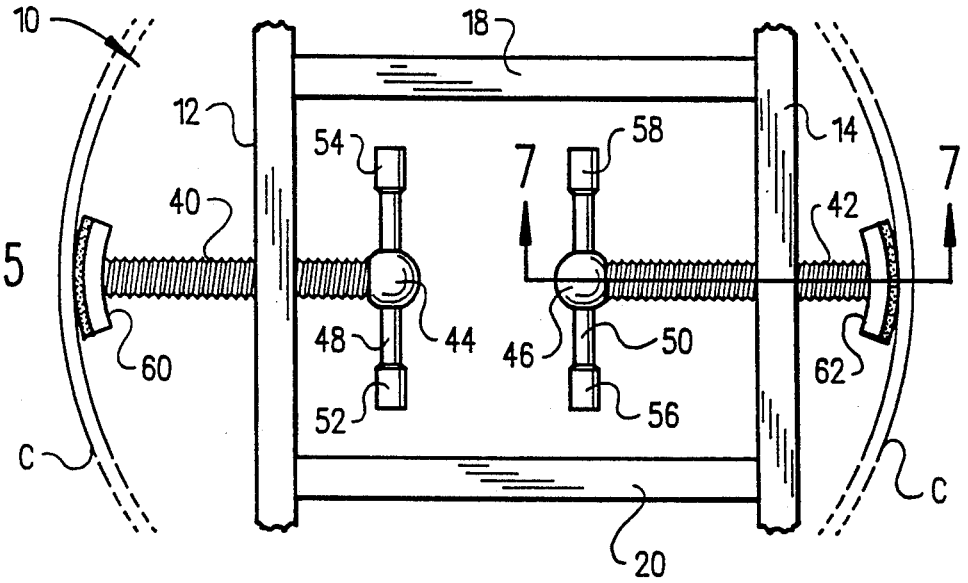
FIG. 5 is a partial top plan view illustrating the manhole casting setting fixture according to the first embodiment of the present invention in operative engagement with a manhole casting.

In the method of utilizing the fixture 10 of the present invention to set a manhole casting in a properly aligned relation, the fixture 10 is first secured to a manhole casting C as illustrated in FIGS. 3, 4 and 5. As shown, the arcuate clamping jaws 60 and 62 are first inserted into the upper end of the hollow cylindrical manhole casting C. The handles 50 and 48 are then rotated until the frictional clamping backing plates 64 secured to the jaws 60 and 62 are disposed in diametrically opposed frictional engagement with an upper interior side wall portion of the casting C. In this condition, the entire fixture and the manhole casting C clamped thereto may be manually carried to an intended installation location by two or more individuals grasping the loop handles 24, 26, 28 and 30 illustrated in FIG. 1. The parallel frame members or rails 12 and 14 are then placed into engagement with the road surface in a manner such that the manhole casting C is in a properly aligned position. Concrete, asphalt, or other paving material is then applied to permanently set the manhole casting C in position. The T-handles 48 and 50 may then be manipulated to disengage the clamping jaws 60 and 62 from the interior side wall portion of the casting C and the fixture 10 removed for reuse.

Figure 6:
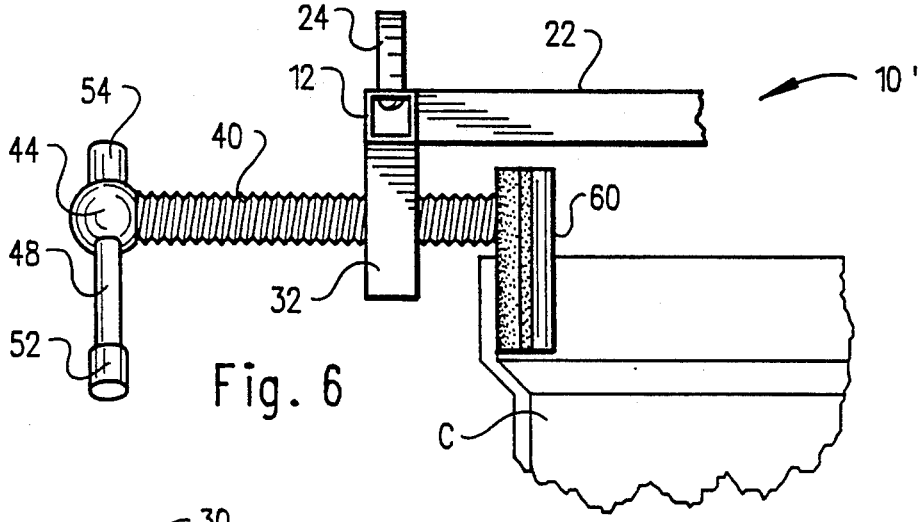
FIG. 6 is a partial detail view illustrating the manhole casting setting fixture according to a slightly modified second embodiment of the invention.

FIG. 6 illustrates an alternative second embodiment 10′ of the invention, in which the T-handles, for example the handle 48, are positioned exteriorly of the associated frame rail 12 and the clamping jaw 60 is disposed on an interior side of the frame rail 12 with respect to the orientation illustrated in the embodiment 10 shown in FIG. 1. Thus, the clamping jaws are directed toward one another and disposed such that they are pulled rather than pushed into engagement with the manhole casting by manipulation of the associated lead screws. This second embodiment 10′, may be formed by a simple on site reconfiguration of the clamping jaws and screw components of the first embodiment 10, and may be employed when required by the dimensions of the casting.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A manhole casting setting fixture, comprising:
- a pair of elongated spaced substantially parallel frame rails;
- a plurality of spaced substantially parallel struts extending substantially transversely between and secured to said frame rails;
- a plurality of handles disposed on upper surfaces at opposite ends of said frame rails to facilitate manual transportation and positioning of said fixture;
- a pair of clamping blocks secured substantially centrally in juxtaposed relation to bottom surfaces of said frame rails;
- a pair of lead screws extending through substantially coaxial threaded apertures in said clamping blocks;
- a pair of arcuate clamping jaws rotatably secured on inner ends of said lead screws between said frame rails and said clamping blocks, each of said clamping jaws having a concave cylindrical outer surface dimensioned for engagement with a cylindrical inner side wall of a manhole casting;

and
- a pair of handles secured to outer ends of said lead screws for moving said clamping jaws independently into clamping engagement with a manhole casting and to allow lateral positioning of said manhole casting between said frame rails.

2. A method of installing a manhole casting, comprising the steps of:

providing:
- a pair of elongated spaced substantially parallel frame rails;
- a plurality of spaced substantially parallel struts extending substantially transversely between and secured to said frame rails;
- a plurality of handles disposed on upper surfaces at opposite ends of said frame rails to facilitate manual transportation and positioning of said fixture;
- a pair of clamping blocks secured substantially centrally in juxtaposed relation to bottom surfaces of said frame rails;
- a pair of lead screws extending through substantially coaxial threaded apertures in said clamping blocks;
- a pair of arcuate clamping jaws rotatably secured on inner ends of said lead screws between said frame rails and said clamping blocks, each of said clamping jaws having a concave cylindrical outer surface dimensioned for engagement with a cylindrical inner side wall of a manhole casting;

and a pair of handles secured to outer ends of said lead screws for moving said clamping jaws independently into clamping engagement with a manhole casting and to allow lateral positioning of said manhole casting between said frame rails;

clamping a manhole casting between said clamping jaws;

moving said fixture and said attached manhole casting to an intended installation site;

positioning said fixture such that said frame rails span a hole in a road surface in which said manhole casting is to be installed;

applying a paving material around said manhole casting;

and unclamping said fixture from said manhole casting and removing said fixture.

3. A method of installing a manhole casting, comprising the steps of:

securing a fixture to a manhole casting at a remote location by clamping engagement with only an interior side wall surface of said manhole casting;

transporting said fixture and attached manhole casting to an intended installation site;

positioning said fixture to span a hole in a road surface in which said manhole is to be installed;

applying a paving material around said manhole casting; and releasing said manhole casting from said fixture and removing said fixture.

4. The method of claim 3, further comprising the step of engaging an interior side wall surface of said manhole casting with a pair of arcuate cylindrical concave surfaces of diametrically opposed clamping jaws secured to said fixture.

5. The method of claim 3, further comprising the step of selectively laterally positioning said manhole casting with respect to said fixture.

6. A manhole casting setting fixture for supporting a manhole casting during installation in a hole in a roadway surface on a mounting structure to which the manhole casting is to be mounted, comprising:

a frame;

clamping means including two releasable clamping jaws having arcuate surfaces dimensioned or engagement with interior cylindrical sidewall portions of the manhole casting for temporarily securing the manhole casting to said frame during installation of the manhole casting and means for moving said arcuate surfaces of said clamping jaws into engagement with the interior cylindrical side wall surfaces of the manhole casting; and support means on said frame for supporting said fixture and the attached manhole casting in mounted position on the mounting structure at an intended installation site without contact of said fixture with the mounting structure to which the manhole casting is to be mounted.

7. The manhole casting setting fixture of claim 6, wherein said support means includes two elongated frame rails dimensioned to span the hole in the roadway surface in which the manhole casting is to be mounted.

8. The manhole castings setting fixture of claim 7, wherein said clamping means is disposed between said frame rails.

9. The manhole casting setting fixture of claim 6, wherein said clamping means includes lead screws driving said clamping jaws.

10. A manhole casting setting fixture for supporting a manhole casting during installation in a hole in a roadway surface on a mounting structure to which the manhole casting is to be mounted, comprising:

two elongated frame members;

a pair of releasable clamping jaws secured to said frame members for temporarily securing the manhole casting to said frame members during installation of the manhole casting, said clamping jaws including concave cylindrical surfaces; and means for moving said concave cylindrical surfaces of said clamping jaws into clamping engagement with the interior cylindrical side wall surfaces of the manhole casting and for independently adjusting said clamping jaws laterally with respect to said frame members for engagement with interior cylindrical side wall surfaces of the manhole casting to allow selective lateral positioning of the manhole casting with respect to said frame members and for supporting the manhole casting in mounted position on the mounting structure at an intended installation site without contact of said fixture with the mounting structure to which the manhole casting is to be mounted.

11. The manhole casting setting fixture of claim 10, wherein said means for independently adjusting said clamping jaws comprises a pair of lead screws.

12. The manhole casting setting fixture of claim 10, further comprising a plurality of handles secured at opposite ends of said frame members to facilitate transportation and positioning of said fixture.

13. The manhole casting setting fixture of claim 10, further comprising a plurality of struts secured between said frame members.

14. The manhole casting setting fixture of claim 13, wherein said frame members are substantially parallel and said struts are substantially perpendicular to said frame members.

15. The manhole casting setting fixture of claim 10, wherein said clamping jaws are disposed between said frame members.

16. The manhole casting setting fixture of claim 10, wherein said clamping jaws are oppositely directed and disposed exteriorly of said frame members.

* * * * *